US006854531B2

(12) United States Patent
Jubinville

(10) Patent No.: US 6,854,531 B2
(45) Date of Patent: Feb. 15, 2005

(54) POST WITH INTEGRAL HAMMER AND ANVIL

(76) Inventor: Leonard Arthur Jubinville, R.R. #2, St. Albert, Alberta (CA), T8N 1M9

( * ) Notice: Subject to any disclaimer, the term of this patent is extended or adjusted under 35 U.S.C. 154(b) by 0 days.

(21) Appl. No.: 10/611,258

(22) Filed: Jun. 30, 2003

(65) Prior Publication Data

US 2004/0003932 A1 Jan. 8, 2004

(30) Foreign Application Priority Data

Jul. 3, 2002 (CA) ..... 2390364

(51) Int. Cl.[7] ..... B25D 17/00
(52) U.S. Cl. ..... 173/90; 173/91; 173/132
(58) Field of Search ..... 173/90, 91, 132; 119/771, 795; 52/155; 248/156; 254/30

(56) References Cited

U.S. PATENT DOCUMENTS

| | | | | | |
|---|---|---|---|---|---|
| 1,605,435 | A | * | 11/1926 | Hansen | 279/19.1 |
| 2,713,327 | A | * | 7/1955 | Binkley | 119/790 |
| 2,790,419 | A | * | 4/1957 | Sullivan | 119/786 |
| 2,902,976 | A | | 9/1959 | Wilson | 119/19 |
| 3,100,476 | A | * | 8/1963 | Peak | 119/786 |
| 3,143,817 | A | | 8/1964 | Paulson | 40/125 |
| 3,159,234 | A | * | 12/1964 | Junk | 181/155 |
| 4,186,690 | A | | 2/1980 | Seiler | 119/110 |
| 4,279,104 | A | | 7/1981 | Classen | 52/38 |
| 4,662,305 | A | * | 5/1987 | Cline | 116/173 |
| 4,802,443 | A | | 2/1989 | Denmark | 119/19 |
| 4,939,877 | A | | 7/1990 | Claffey | 52/155 |
| 5,031,577 | A | | 7/1991 | Flugger | 119/117 |
| 5,375,801 | A | | 12/1994 | Porter | 248/156 |
| 5,456,214 | A | | 10/1995 | Quilling | 119/795 |
| 5,833,215 | A | | 11/1998 | Vandenburg | 254/30 |
| 5,875,951 | A | * | 3/1999 | Ingle et al. | 227/147 |
| 6,142,103 | A | | 11/2000 | Meyers et al. | 119/771 |

* cited by examiner

*Primary Examiner*—Scott A. Smith
*Assistant Examiner*—Nathaniel Chukwurah
(74) *Attorney, Agent, or Firm*—Christensen O'Connor Johnson Kindness PLLC

(57) ABSTRACT

A post includes an elongate ground piercing member having a ground piercing end and an anvil end at which is positioned an anvil. The anvil is positioned within an interior cavity of a housing with the ground piercing member extending through a second end of the housing. Relative movement of the ground piercing member and the housing brings a first hammer into contact with the anvil to drive the ground piercing member into the ground. Relative movement of the ground piercing member and the housing brings a second hammer into contact with the anvil to remove the ground piercing member from the ground. A lock is provided to selectively limit relative movement of the ground piercing member and the housing to prevent the second hammer from contacting the second striking face of the anvil.

7 Claims, 7 Drawing Sheets

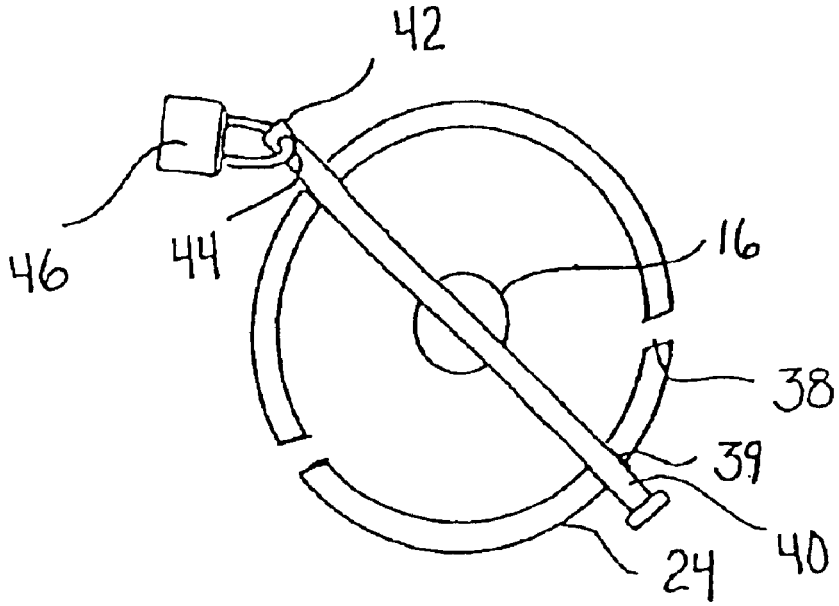
FIG. 6
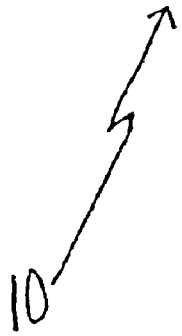

POST WITH INTEGRAL HAMMER AND ANVIL

FIELD OF THE INVENTION

The present invention relates to a post with an integral hammer and anvil, which is used to pound the post into the ground and remove the post.

BACKGROUND OF THE INVENTION

U.S. Pat. No. 3,143,817 (Paulson 1964) discloses a post with an integral hammer and anvil that enables a ground piercing member forming part of the post to be hammered into the ground or hammered out of the ground. The ground piercing member is elongate and has a ground piercing end and an anvil end. An anvil is positioned at the anvil end of the ground piercing member. This anvil has a first striking face and a second striking face. The first striking face is opposed to the second striking face. A tubular housing is provided a first end, a second end, and an interior cavity. The anvil is positioned within the interior cavity of the housing with the ground piercing member extending through the second end of the housing. A first hammer is positioned at the first end of the housing. Relative movement of the ground piercing member and the housing brings the first hammer into contact with the first striking face of the anvil to drive the ground piercing end of the ground piercing member into the ground. A second hammer is positioned at the second end of the housing. Relative movement of the ground piercing member and the housing brings the second hammer into contact with the second striking face of the anvil to remove the ground piercing end of the ground piercing member from the ground.

When a post similar to that disclosed in the Paulson reference is used to tether horses, problems arise. In response to a force exerted by the horse, the post tends to telescopically extend. Once the post is in a telescopically extended position, the horse is able to exert sufficient leverage to either pull the post out of the ground or bend ground piercing member.

SUMMARY OF THE INVENTION

What is required is an improved form of post that will address the problem in the prior art.

According to the present invention there is provided a post which includes an elongate ground piercing member having a ground piercing end and an anvil end. An anvil is positioned at the anvil end of the ground piercing member. The anvil has a first striking face and a second striking face. The second striking face is opposed to the first striking face. A tubular housing has a first end, a second end, and an interior cavity. The anvil is positioned within the interior cavity of the housing with the ground piercing member extending through the second end of the housing. A first hammer is positioned at the first end of the housing. Relative movement of the ground piercing member and the housing brings the first hammer into contact with the first striking face of the anvil to drive the ground piercing end of the ground piercing member into the ground. A second hammer is positioned at the second end of the housing. Relative movement of the ground piercing member and the housing brings the second hammer into contact with the second striking face of the anvil to remove the ground piercing end of the ground piercing member from the ground. A lock is provided which engages the ground piercing member and the housing. This selectively limits relative movement of the ground piercing member and the housing to prevent the second hammer from contacting the second striking face of the anvil.

Providing the post with a lock, as described above, prevents the telescopic extension of the post. This makes the post suitable for use with horses and other domestic animals. Beneficial results have been obtained through the use of a lock which includes a transverse passage which is adapted to receive a locking pin. The transverse passage is spaced from the first end of the housing, laterally spaced from the ground piercing member and underlies the anvil. The locking pin engages the anvil on the ground piercing member to limit relative movement of the ground piercing member and the housing.

Although beneficial results may be obtained through the use of the post, as described above, the post has utility as a signpost and in a number of applications for which theft would be a matter of concern. Even more beneficial results may, therefore, be obtained when the pin has a remote end which has an aperture adapted to receive a padlock.

In order to adapt the post for use with animals means must be provided to attach a tethering line. It is preferred that the means for attaching a tethering line be positioned adjacent to the second end of the housing. This positioning is intended to make it practically impossible for the animal to pull the post over.

Although beneficial results may be obtained through the use of the invention as a tethering post, as described above, animals can become tangled in the tethering line. Even more beneficial results may, therefore, be obtained when a portion of the tethering line positioned immediately adjacent to the animal is covered by a rigidifying sleeve.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein:

FIG. 6 is top plan view, in section, of the post illustrated in FIG. 1, with locking pin in a second transverse passage to prevent relative rotation between the ground piercing member and the housing.

DETAILED DESCRIPTION OF THE PREFERRED EMBODIMENT

Figure 1:
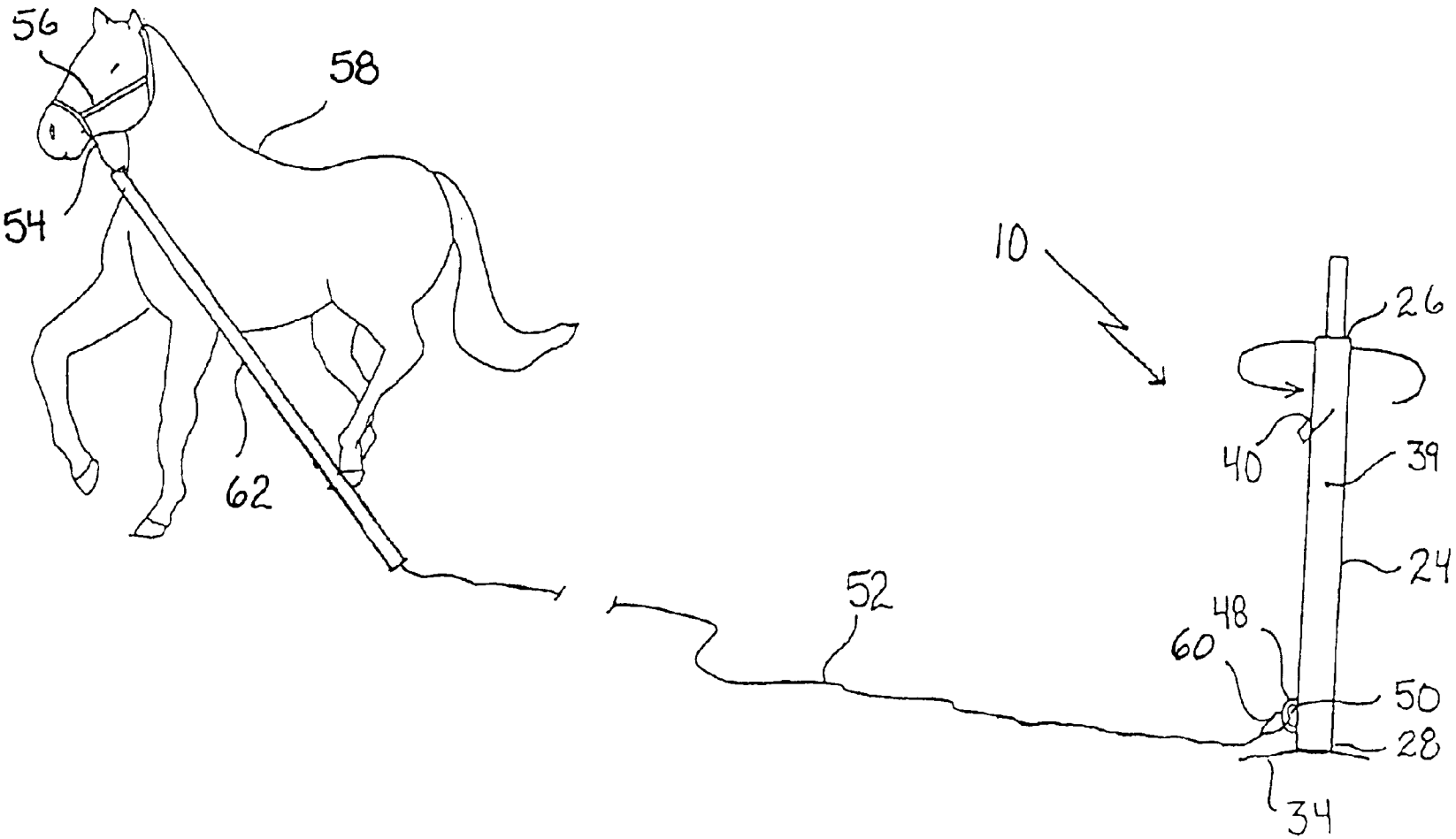
FIG. 1 is perspective view of a post fabricated in accordance with the teachings of the present invention being used to tether a horse.

The preferred embodiment, a post generally identified by reference numeral 10, will now be described with reference to FIGS. 1 through 7.

Figure 2:
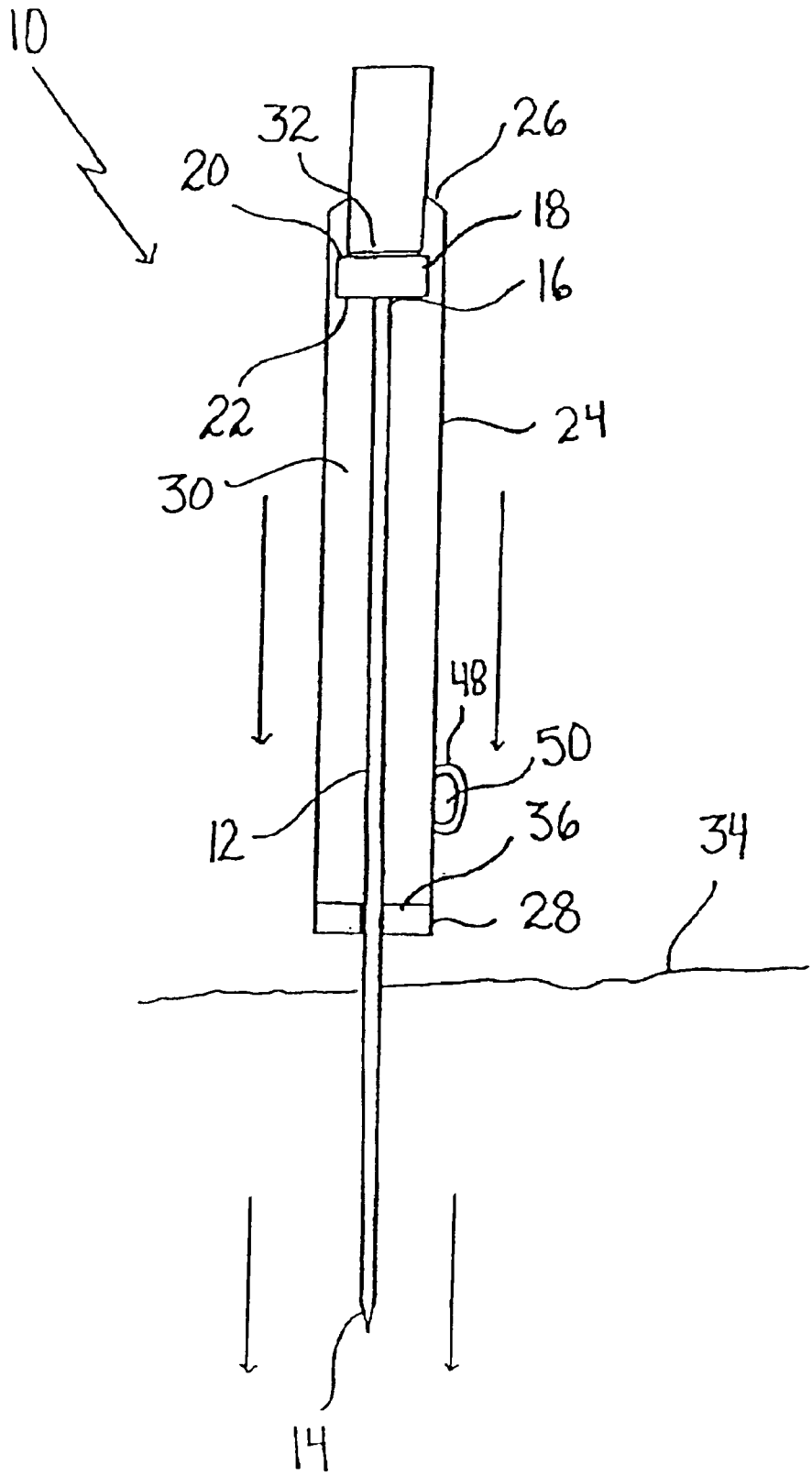
FIG. 2 is side elevation view, in section, of the post illustrated in FIG. 1 being pounded into the ground.
Figure 3:
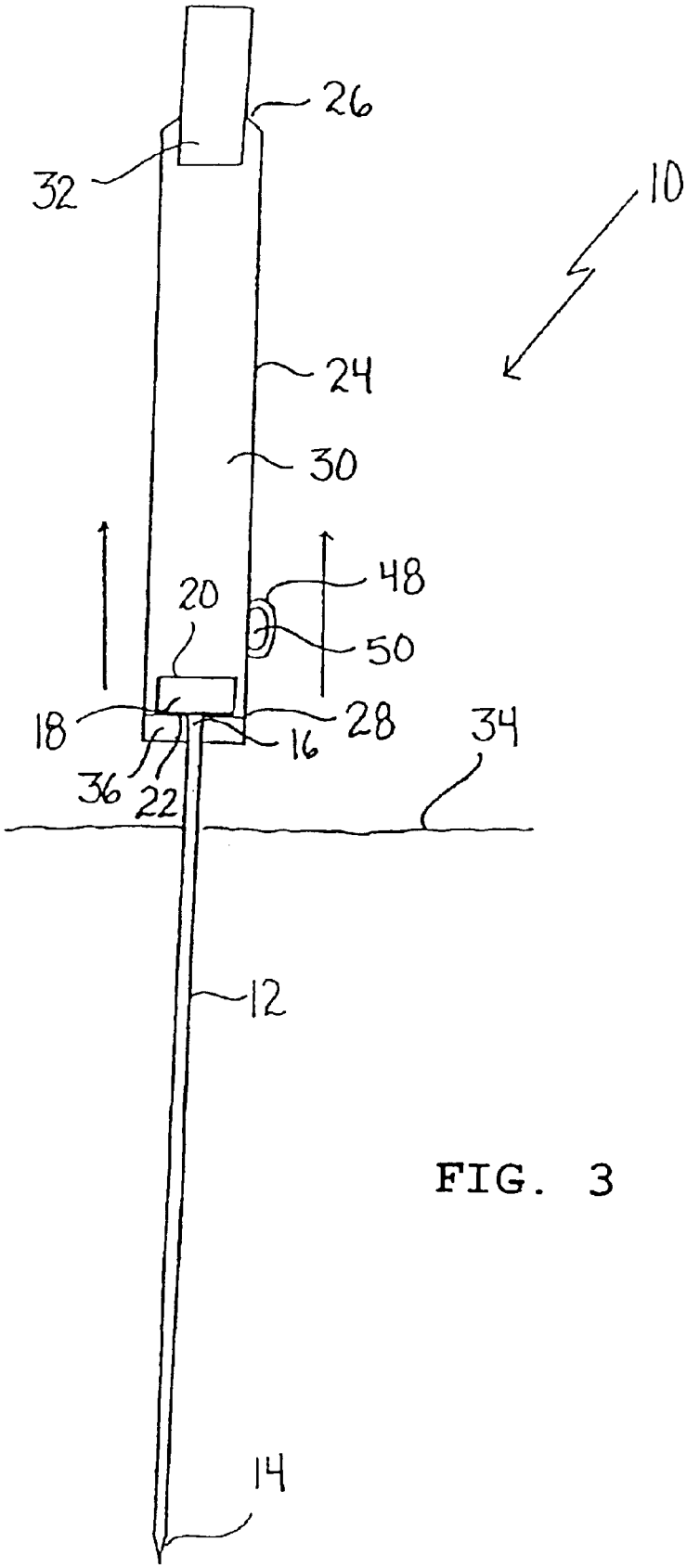
FIG. 3 is side elevation view, in section, of the post illustrated in FIG. 1 being pounded out of the ground.

Structure and Relationship of Parts:

Referring to FIG. 2, there is provided a post 10 that includes an elongate ground piercing member 12 that has a ground piercing end 14 and an anvil end 16 at which is positioned an anvil 18. Anvil 18 has a first striking face 20 and a second striking face 22. A tubular housing 24 is provided that has a first end 26, a second end 28, and an interior cavity 30. Anvil 18 is positioned within interior cavity 30 of housing 24 with ground piercing member 12 extending through second end 28 of housing 24. A first hammer 32 is positioned at first end 26 of housing 24, such that relative movement of ground piercing member 12 and housing 24 brings first hammer 32 into contact with first striking face 20 of anvil 18 to drive ground piercing end 14 of ground piercing member 12 into the ground 34. Referring to FIG. 3, a second hammer 36 is positioned at second end 28 of housing 24, such that relative movement of ground piercing member 12 and housing 24 brings second hammer 36 into contact with second striking face 22 of anvil 18 to remove ground piercing end 14 of ground piercing member 12 from ground 34.

Figure 4:
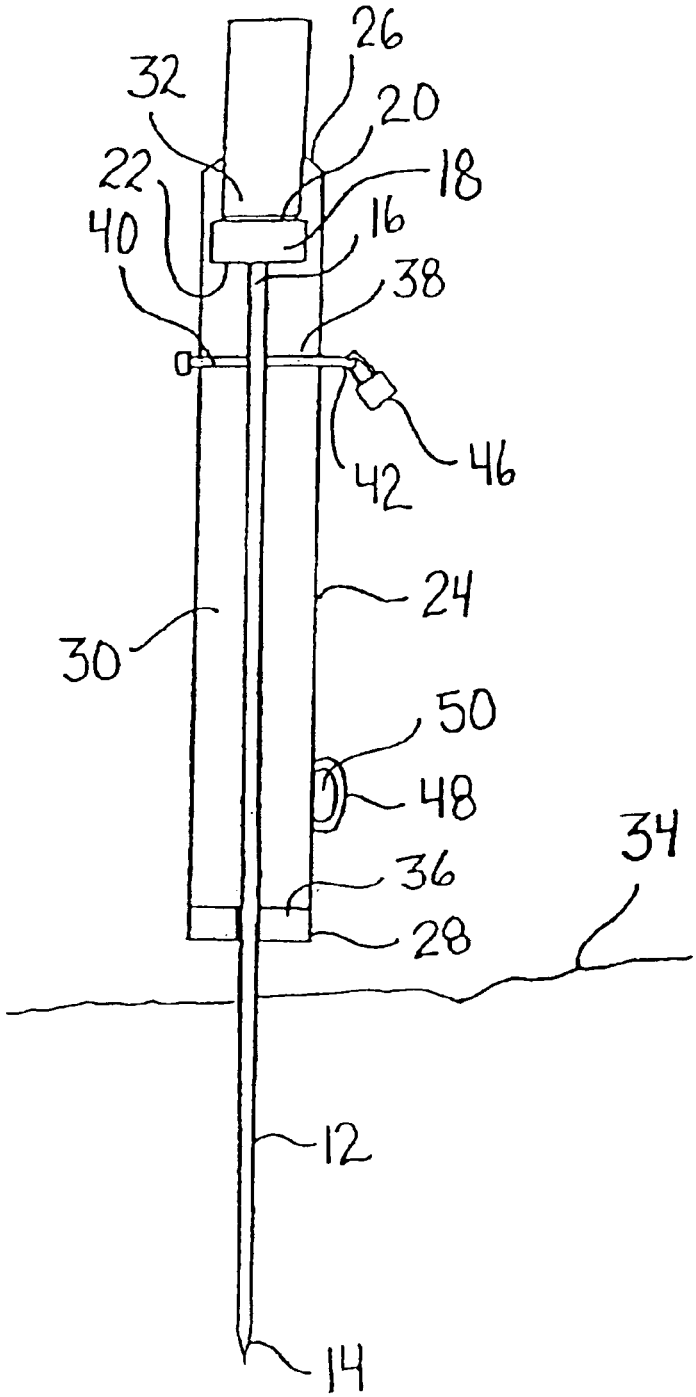
FIG. 4 is side elevation view, in section, of the post illustrated in FIG. 1 locked to prevent unauthorized removal.
Figure 5:
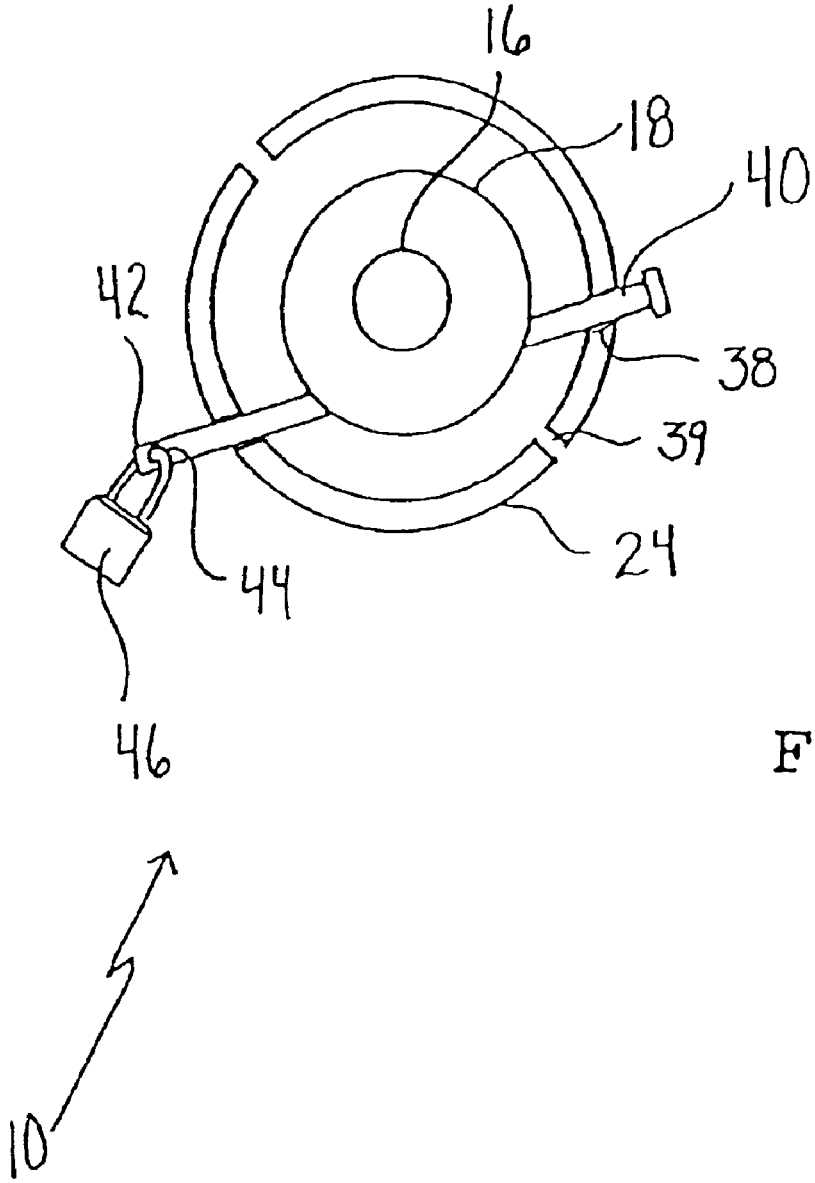
FIG. 5 is a top plan view, in section, of the post illustrated in FIG. 1, with locking pin in a first transverse passage to allow relative rotation between the ground piercing member and the housing.

Referring to FIG. 4, a transverse passage 38 is adapted to receive a locking pin 40 that is spaced from first end 26 of housing 24. Transverse passage 38 is laterally spaced from ground piercing member 12 and underlies anvil 18 such that locking pin 40 engages anvil 18 to thereby limit relative movement of ground piercing member 12 and housing 24. This prevents second hammer 36 from contacting second striking face 22 of anvil 18, and discourages unauthorized removal of post 10. Referring to FIG. 5, locking pin 40 has a remote end 42 which has an aperture 44 adapted to receive a padlock 46.

Figure 7:
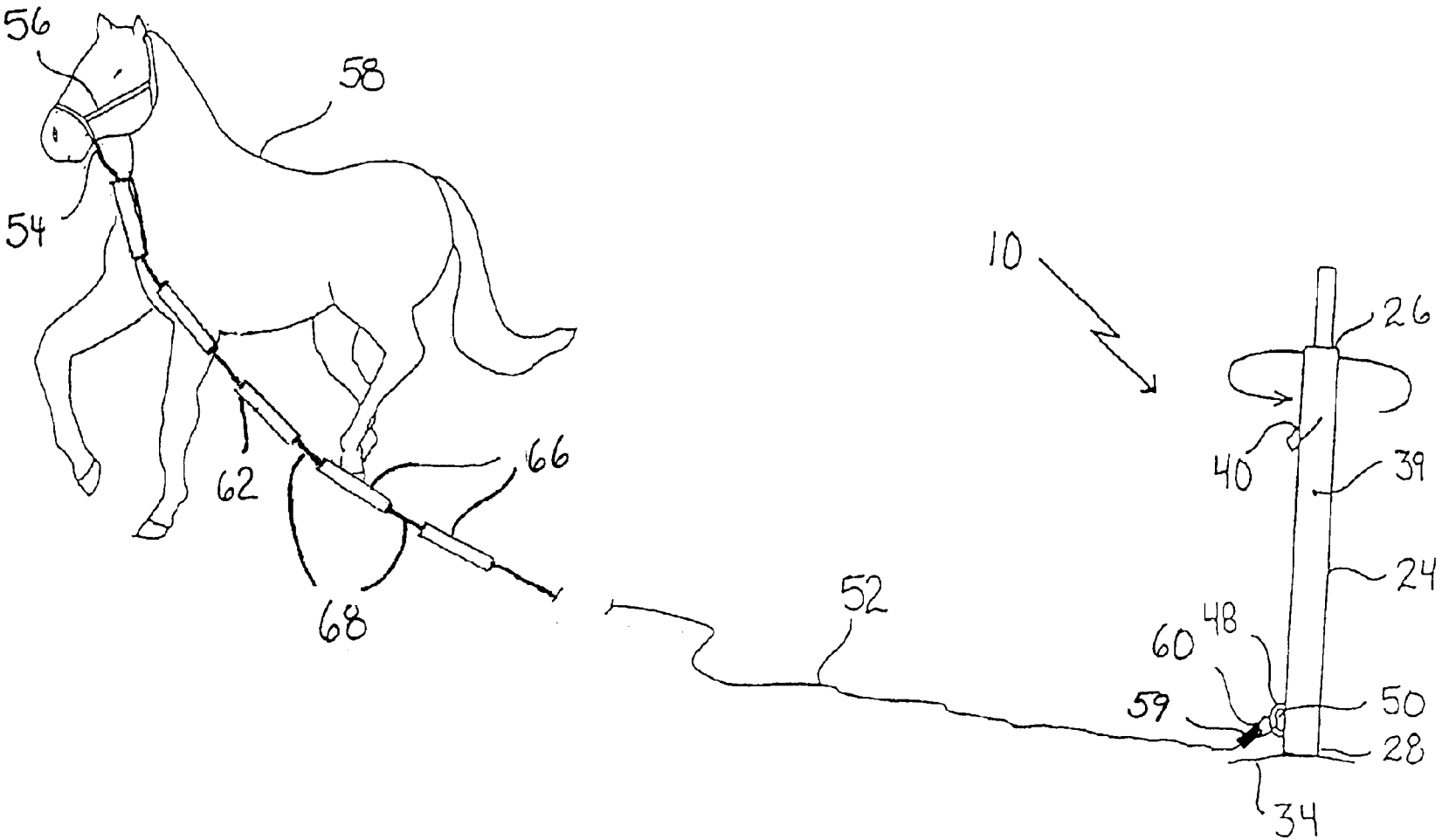
FIG. 7 is perspective view of the post fabricated illustrated in FIG. 1, used with a tether line having a segmented sleeve.

Referring to FIG. 4, an attachment tab 48 is positioned adjacent to second end 28 of housing 24. Referring to FIG. 1, attachment tab 48 has an opening 50 adapted for attachment of a tethering line 52. Tethering line 52 has a first end 54 adapted to be secured to a collar or harness 56 of an animal 58 to be tether. A second end 60 is adapted to be secured to opening 50 of attachment tap 48 on housing 24. A portion of tethering line 52 that positioned adjacent to animal 58, as will hereinafter be further described, is covered by a rigidifying sleeve 62. Rigidifying sleeve 62 is of a sufficient length to extend beyond a back leg 64 of tethered animal 58. Rigidifying sleeve 62 can be unitarily formed as illustrated in FIG. 1, or can be made up of two or more rigidifying segments 66, as illustrated in FIG. 7. Rigidifying segments 66 can attached directly onto line or can be joined by flexible members 68.

Operation:

The use and operation of post generally identified by reference numeral 10, will now be described with reference to FIGS. 1 through 7. Referring to FIG. 1, there is provided post 10 as described above, with horse 58 tethered to post 10 by tethering line 52. Although post 10 is shown in use with horse 58, it will be appreciated that post 10 could also be used in association with other animals, or even in other application such as a signpost or anchor for any item.

Referring to FIG. 2, in order to use post 10, first hammer 32 is brought into violent contact with first striking face 20 of anvil 18 to drive ground piercing end 14 of ground piercing member 12 into ground 34. Referring to FIG. 4, once ground piercing end 14 of ground piercing member 12 is securely embedded in ground 34, locking pin 40 is inserted into transverse passage 38. Referring to FIG. 5, padlock 46 is then inserted through aperture 44 at remote end 42 of locking pin 40 and locked. Referring to FIG. 4, padlock 46 prevents locking pin 40 from being removed. Locking pin 40 engages anvil 18 to limit relative movement of ground piercing member 12 and housing 24 to prevent second hammer 36 from contacting second striking face 22 of anvil 18. Post 10 cannot, therefore, be removed from ground 34 in which it is embedded until locking pin 40 is removed from transverse passage 38.

Referring to FIG. 1, horse 58 can then be tethered to post 10 by attaching swivel 59 at second end 60 of tethering line 52 to attachment tab 48. It will be appreciated that a swivel 59 could also be positioned at first end 54 of tethering 52 line as well. Attachment tab 48 is positioned adjacent to second end 28 of housing 24, so that horse 58 is unable to exert any leverage to loosen post 10 or pull post 10 over. Rigidifying sleeve 62 covers a portion of tethering line 52 at first end 54 to prevent horse from becoming become tangled in tethering line 52. Rigidifying sleeve 62 is of a sufficient length to extend beyond a back leg 64 of tethered animal 58. Rigidifying sleeve 62 can be unitarily formed as illustrated in FIG. 1, or can be made up of segments as illustrated in FIG. 7.

Referring to FIG. 4, when it becomes necessary to remove post 10. Padlock 46 unlocked and removed from remote end 42 of locking pin 40. Locking pin 40 is then removed from transverse passage 38. Referring to FIG. 3, with locking pin 40 removed, relative movement of ground piercing member 12 and housing 24 is no longer impeded. Relative movement of ground piercing member 12 and housing 24 therefore brings second hammer 36 into contact with second striking face 22 of anvil 18 to remove ground piercing end 14 of ground piercing member 12 from ground 34. This can be done either with tether line 52 connected or disconnected from post 10.

The example given above relates to the tethering of a horse 58. When tethering a horse 58, it is preferred that tubular housing 24 be able to rotate. If tubular housing 24 does not rotate tethering line 52 will become wrapped around post 10 and shortened as horse 58 circles post 10. In order to permit tubular housing 24 to rotate, locking pin 40 must be positioned to one side of anvil end 16 of ground piercing member 12, as is illustrated in FIGS. 4 and 5. However, if relative rotation of ground piercing member 12 and housing 12 is not desired, locking pin 40 can be inserted into second transverse passage 39 which extends right through ground piercing member 12. An example of an application in which rotation is not desirable is for a sign post. Referring to FIG. 1, it is preferred that a first transverse passage 38 and a second transverse passage 39 be provided through housing 24. Referring to FIGS. 4 and 5, first transverse passage 38 is laterally offset from ground piercing member 12. Referring to FIG. 6, second transverse passage 39 extends directly through ground piercing member 12. This enables the user to decide whether to rotationally affix or non-rotationally affix housing 24 to ground piercing member 12 by reselecting first transverse passage 38 or second transverse passage 39.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiment of the invention in which an exclusive property or privilege is claimed are defined as follows:

1. A post, comprising:

an elongate ground piercing member having a ground piercing end and an anvil end at which is positioned an anvil, the anvil having a first striking face and a second striking face, the second striking face being opposed to the first striking face;

a tubular housing having a first end, a second end, and an interior cavity, the anvil being positioned within the interior cavity of the housing with the ground piercing member extending through the second end of the housing;

a first hammer positioned at the first end of the housing, such that relative axial movement of the ground piercing member and the housing brings the first hammer into contact with the first striking face of the anvil to drive the ground piercing end of the ground piercing member into the ground;

a second hammer positioned at the second end of the housing, such that relative axial movement of the ground piercing member and the housing brings the second hammer into contact with the second striking face of the anvil to remove the ground piercing end of the ground piercing member from the ground; and a lock engaging the ground piercing member and the housing to selectively limit relative axial movement of the ground piercing member and the housing to prevent the second hammer from contacting the second striking face of the anvil, the lock including a transverse passage spaced from the first end of the housing which is adapted to receive a locking pin, the locking pin engaging the anvil end of the ground piercing member to limit relative axial movement of the ground piercing member and the housing, the transverse passage being laterally spaced from the ground piercing member and underlying the anvil such that the locking pin permits relative rotational movement of the ground piercing member and the housing, while engaging the anvil to limit relative axial movement of the ground piercing member and the housing.

2. The post as defined in claim 1, wherein the locking pin has a remote end which has an aperture adapted to receive a padlock.

3. The post as defined in claim 1, wherein means is provided to attach a tethering line adjacent to the second end of the housing.

4. A post, comprising:

an elongate ground piercing member having a ground piercing end and an anvil end at which is positioned an anvil, the anvil having a first striking face and a second striking face;

a tubular housing having a first end, a second end, and an interior cavity, the anvil being positioned within the interior cavity of the housing with the ground piercing member extending through the second end of the housing;

a first hammer positioned at the first end of the housing, such that relative axial movement of the ground piercing member and the housing brings the first hammer into contact with the first striking face of the anvil to drive the ground piercing end of the ground piercing member into the ground;

a second hammer positioned at the second end of the housing, such that relative axial movement of the ground piercing member and the housing brings the second hammer into contact with the second striking face of the anvil to remove the ground piercing end of the ground piercing member from the ground;

a first transverse passage adapted to receive a locking pin being spaced from the first end of the housing, the transverse passage being laterally spaced from the ground piercing member and underlying the anvil such that the locking pin permits relative rotational movement of the ground piercing member and the housing, while engaging the anvil to limit relative axial movement of the ground piercing member and the housing to prevent the second hammer from contacting the second striking face of the anvil; and an attachment tab positioned adjacent to the second end of the housing, the attachment tab having an opening adapted for attachment of a tethering line for an animal.

5. The post as defined in claim 4, in combination with a tethering line, wherein a portion of the tethering line positioned immediately adjacent to the animal is covered by a rigidifying sleeve.

6. The post as defined in claim 4, wherein the locking pin has a remote end which has an aperture adapted to receive a padlock.

7. The post as defined in claim 4, wherein a second transverse passage is provided which extends through both the housing and the piercing member, such that the locking pin when extended through the second transverse passage engages the anvil end of the ground piercing member to limit relative rotational movement of the ground piercing member and the housing while limiting relative axial movement of the ground piercing member and the housing to prevent the second hammer from contacting the second striking face of the anvil.

* * * * *